United States Patent [19]

Miersch

[11] 3,977,006

[45] Aug. 24, 1976

[54] COMPENSATED TRAVELING WAVE SLOTTED WAVEGUIDE FEED FOR COPHASAL ARRAYS

[75] Inventor: Horst K. Miersch, Douglaston, N.Y.

[73] Assignee: Cutler-Hammer, Inc., Milwaukee, Wis.

[22] Filed: May 12, 1975

[21] Appl. No.: 576,260

[52] U.S. Cl. ..... 343/778; 343/853

[51] Int. Cl.[2] ..... H01Q 13/00

[58] Field of Search ..... 343/776, 777, 778, 779, 343/, 854, 768, 771, 852

[56] References Cited

UNITED STATES PATENTS

| | | | |
|---|---|---|---|
| 2,959,783 | 11/1960 | Iams | 343/854 |
| 3,109,174 | 10/1963 | Plummer | 343/777 |
| 3,234,559 | 2/1966 | Bartholoma et al. | 343/779 |

FOREIGN PATENTS OR APPLICATIONS

| | | | |
|---|---|---|---|
| 1,263,925 | 5/1960 | France | 343/854 |

*Primary Examiner*—Eli Lieberman

*Attorney, Agent, or Firm*—Kevin Redmond

[57] ABSTRACT

Radiator slots spaced along a main waveguide are coupled to respective array element ports through branch waveguides proportioned to provide equal length transmission paths from a common feed port on the main waveguide.

6 Claims, 1 Drawing Figure

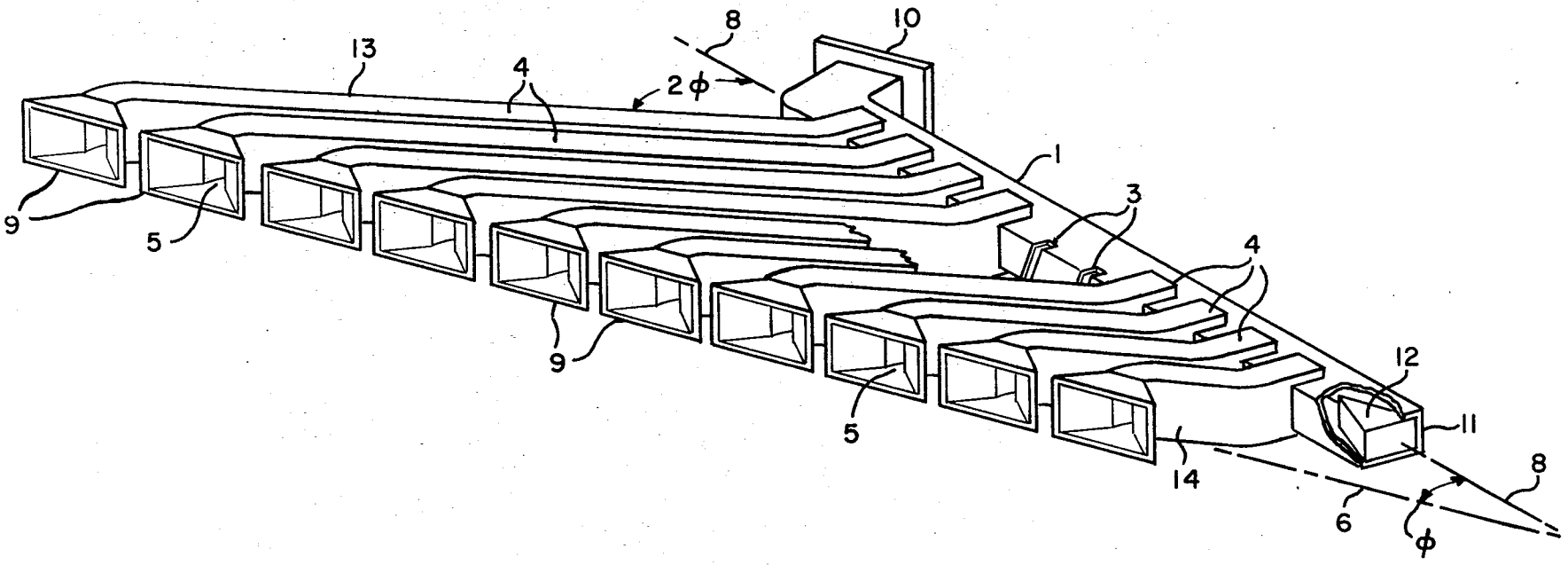
8
11
12
φ
6
4
14
3
1
10
5
8
2φ
9
4
13
5
9

COMPENSATED TRAVELING WAVE SLOTTED WAVEGUIDE FEED FOR COPHASAL ARRAYS

BACKGROUND

1. Field

This invention relates to an improved distribution network or feed structure for coupling a common feed port to an array of utilization elements, such as radiators, in a frequency-independent cophasal relationship.

2. Prior Art

Waveguide-slot antenna arrays are well known; a comprehensive description of these appears in Chapter 9, pages 9–1 to 9–18 of *Antenna Engineering Handbook*, edited by Henry Jasik, First Edition, published by McGraw-Hill, Inc., 1961. The structures are mechanically simple and compact, economical to fabricate, and can be designed to provide excellent beam patterns with low sidelobes, and to exhibit only small impedance variations, over substantial bandwidths.

Such arrays exhibit the usually undesirable, and in some cases unacceptable, characteristic that the beam pointing direction varies as a function of frequency. If signals consisting of very short pulses are used, the pulse shape becomes distorted because each fourier component of the pulse is associated with a different pointing direction. In addition, the array aperture must be limited to a size such that the propagation time over the length of the waveguide is substantially less than the pulse duration. Further, waveguide-slot arrays, particularly those in which the slots are inclined, exhibit strong cross-polarized components in certain off-axis directions within the beam, requiring some type of mode filter if they are to be eliminated. Finally, dimensional changes caused by ambient temperature variations can produce undesirable changes in beam pointing.

Other types, for example corporate-fed arrays, can be designed and constructed to provide the desirable performance characteristics of waveguide-slot arrays without the above mentioned undesirable ones. However, such other types are generally much more complex, bulky and expensive to fabricate than waveguide-slot arrays.

SUMMARY

According to this invention, the advantages of the waveguide-slot array are secured and the disadvantages eliminated by a feed system comprising a modified waveguide-slot structure provided with a compensating arrangement of branch waveguides, each extending between a respective slot and an individual element port adapted to be coupled to a corresponding radiator element of an ultimate array. The branch waveguides are of such dimensions that the total electrical length of the transmission path from a main feed port to any element port is the same. The element ports are thus coupled both cophasally and contemporaneously to the main feed port. As a result, the directive pattern of an array of radiators, such as horns, connected to the element ports will have a pointing angle independent of frequency and temperature. The array size is not limited by pulse length because there is no aperture-filling differential time. If the branch waveguides are of the usual rectangular configuration, cross polarized field components are unable to propagate through them, and so are not radiated or received.

DRAWING

The single FIGURE of the drawing is a view in trimetric projection showing a preferred embodiment of the feed structure of the invention, coupling a common feed port to a typical array of antenna elements.

DESCRIPTION OF THE PREFERRED EMBODIMENT

The illustrated structure comprises a main waveguide 1 of usual rectangular cross section provided with an array of slots 3 disposed along one of its narrow walls, and a plurality of branch waveguides 4, each coupled at one of its ends to a respective one of slots 3. The open ends 5 of the branch waveguides 4 remote from the main waveguide are hereinafter referred to as array ports.

The array ports are disposed at intervals along an array line extending in the direction indicated by line 6. The array line lies at an acute angle $\phi$ with respect to the longitudinal axis 8 of the main waveguide. Preferably, although not necessarily, the angle $\phi$ is less than 45°, say about 20°.

In the present example, the array ports are connected directly to the throats of respective horn-like radiator elements 9 which are similarly directed perpendicularly to the array line. The branch waveguides 4 may be curved near their ends as shown so as to approach the array line and the main waveguide squarely. Throughout the major portions of their lengths, between the curved end regions, the branch waveguides lie parallel to each other and at an angle $2\phi$ with respect to the main waveguide.

The end 10 of the main waveguide nearer the longest branch waveguide 13 constitutes the main feed port, and is adapted to be connected by way of a flange to microwave transmitter and/or receiver equipment, not shown. The other end 11 of waveguide 1, nearer the shortest branch waveguide 14, may be terminated as by a tapered block 12 of dissipative material.

The slots 3 are inclined at respective angles from perpendicularity to the broad walls of waveguide 1. As in the conventional edge-slot waveguide array, the angle of inclination of each slot is determined in known manner to provide the required degree of coupling to the main waveguide at that location. Preferably the slots 3 are spaced along the waveguide 1 at intervals somewhat less or somewhat greater than one-half guide wavelength for all frequencies throughout the intended operating band, as in the so-called nonresonant slot array antenna. However, the slots 3 are all inclined in the same sense, for example, clockwise, rather than alternately inclined in opposite senses as in the usual slot array antenna.

The slots may extend beyond the narrow walls of the main waveguide into the broadwalls to obtain the required length for resonance. The main and branch waveguides are dimensioned to support the $TE_{10}$ mode, but their broadwalls are oriented orthogonally to accommodate a 90° rotation in the E-field which occurs as the signals pass through the slots.

The waveguides are joined by notching the broadwalls of the branch waveguides at one end to accept the narrow wall of the main waveguide. The notched ends enclose the portions of the slots in the narrow wall of the main waveguide, while the protrusions of the branch waveguides above and below the notches extend over the broadwalls of the main waveguide, enclosing the portions of the slots that extend into this region.

A signal supplied to the system through the main feed port 10 travels through the main waveguide towards the terminating block 12, coupling energy to the branch guides by way of the slots. The slots are spaced along the main waveguide at non-resonant intervals, such as 0.45 or 0.55 wavelengths to prevent reflection reinforcement and thus maintain a low VSWR at the main input port. The slots are inclined in the same sense to pass the signals through the slots with the same phase shift. This type of coupling arrangement is referred to hereinafter as like-polarity coupling.

The branch waveguides in this invention are adjusted in length to equalize the path length and thus the propagation time from the main feed port 10 to the radiator elements 9. For example, the path lengths from the main input port 10 to the respective radiator elements of the longest branch waveguide 13 and the shortest branch waveguide 14 are identical. The waveguide 13 is longer than the waveguide 14 to compensate for the additional path length the signal must travel through the main waveguide to reach the waveguide 14.

For broadband applications, the change in propagation velocity with changes in frequency must be identical for all paths. This is easily achieved by using waveguide of the same width throughout the system. As a result of the equalization of the path lengths and the like-polarity coupling through the slots, all the signals emerging from the radiator elements 9 are cophasal and contemperaneous.

This feature of the invention overcomes the variations in beam direction occurring in conventional slotted array because of variations in temperature and frequency. The beam direction in a slotted array is a function of the relative phase of the signals emitted from each radiator. Variations in temperature change the dimensions of the waveguides including the spacing between the slots as well as the width of the waveguide. These changes vary the propagation time between the slots and thus the relative phase of the signals radiated from the slots of a conventional array.

Changes in frequency have a similar effect on the relative phase of the signals radiated from the slots. Although the slot separation may remain dimensionally constant, it varies in terms of wavelength and phase as a function of frequency, causing the beam direction to vary accordingly.

In the present invention, the direction of the antenna beam does not change significantly with changes in temperature or frequency. For example, the change in the beam direction of an experimental model of the present invention is only $\pm 0.06°$ over the frequency range of 15 to 16 GHz. Although the path length in terms of phase from the main input port to each radiator is subject to variation with changes in temperature and frequency, the radiated signals remain cophasal and contemperaneous because these variations are identical in all paths.

The radiation of undesired cross polarized energy, often encountered in conventional slotted arrays, is reduced in the present invention by the orthogonal orientation of the main and branch waveguides. The orientation of the branch waveguides with respect to the E-field of the cross polarized energy prevents its propagation from the slots to the radiator elements.

The feed system as shown in the FIGURE may be made more compact by reducing the distance from the main feed port to the array line. This is accomplished quite simply and without any loss in aperture by reducing the angle $\phi$. There is, however, a point reached where the branch waveguides mechanically interfere with one another, preventing any further reduction in $\phi$ with standard height waveguide. By substituting reduced height waveguide for the standard height guide, the space between the branch waveguides is increased, making it possible to reduce $\phi$ further before mechanical interference occurs. No change in the length of the branch guides is necessary when reduced height guide is substituted for the standard guide as the propagation velocity is identical.

I claim:

1. A traveling wave slot feed structure for coupling a common feed port cophasally to an array of utilization elements, comprising:

a. a main waveguide adapted to be connected at one end to the common feed port, b. a plurality of slots, one for each of the utilization elements, located at intervals along said waveguide and so disposed transversely thereof as to couple in like polarity to the interior of the waveguide, and c. a plurality of branch waveguides, each coupled at one of its ends to one of said slots and adapted to be connected at the second of its ends to one of said elements, d. said branch waveguides having the same propagation velocity as a function of frequency as said main waveguide, and respective lengths such that the transmission paths between said feed port end of said main waveguide and said second ends of said branch waveguides are of equal lengths.

2. The invention set forth in claim 1, wherein said second ends of said branch waveguides are disposed along an array line that lies at an angle of less than 45° with respect to the longitudinal axis of said main waveguide.

3. The invention set forth in claim 2, wherein said branch waveguides are parallel to each other, and each lies at an angle with respect to said main waveguide that is twice that between said array line and said main waveguide.

4. The invention set forth in claim 3, wherein said main waveguide is of rectangular cross section, with its broad walls lying in planes parallel to said line, said slots are in the narrow wall of said mmain waveguide that faces toward said line, and said branch waveguides are of rectangular cross section, with their broad walls lying in planes perpendicular to the broad walls of said main waveguide.

5. The invention set forth in claim 4, wherein the broad walls of said branch waveguides are of the same breadth as those of said main waveguide.

6. The invention set forth in claim 5, wherein the narrow walls of said branch waveguides are narrower than those of said main waveguide.

* * * * *